US006921343B2

(12) United States Patent
Solheim

(10) Patent No.: US 6,921,343 B2
(45) Date of Patent: Jul. 26, 2005

(54) METHODS AND APPARATUS FOR A GOLF CLUB HEAD WITH AN ENCAPSULATED INSERT

(75) Inventor: John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/152,920

(22) Filed: May 21, 2002

(65) Prior Publication Data

US 2003/0220156 A1 Nov. 27, 2003

(51) Int. Cl.[7] ..... A63B 53/04
(52) U.S. Cl. ..... 473/329; 473/332; 473/340
(58) Field of Search ..... 473/324, 326, 473/329, 332, 333, 334, 335, 336, 337, 338, 339, 340, 342, 345, 346, 347, 349

(56) References Cited

U.S. PATENT DOCUMENTS

| | | | | |
|---|---|---|---|---|
| 4,313,607 A | * | 2/1982 | Thompson | 473/328 |
| 4,523,759 A | | 6/1985 | Igarashi | |
| 4,930,781 A | * | 6/1990 | Allen | 473/346 |
| 5,342,052 A | * | 8/1994 | Costa | 473/329 |
| 5,351,958 A | * | 10/1994 | Helmstetter | 473/346 |
| 5,380,010 A | * | 1/1995 | Werner et al. | 473/346 |
| 5,674,132 A | | 10/1997 | Fisher | |
| 5,716,290 A | | 2/1998 | Baker et al. | |
| 5,718,644 A | | 2/1998 | Donofrio | |
| 5,766,092 A | * | 6/1998 | Mimeur et al. | 473/329 |
| 5,782,706 A | | 7/1998 | DePriest | |
| 5,820,481 A | | 10/1998 | Raudman | |
| 5,842,935 A | | 12/1998 | Nelson | |
| 5,899,821 A | * | 5/1999 | Hsu et al. | 473/332 |
| 5,944,619 A | | 8/1999 | Cameron | |
| 6,001,031 A | * | 12/1999 | San Juan | 473/340 |
| D426,599 S | | 6/2000 | Morgan et al. | |
| 6,086,485 A | * | 7/2000 | Hamada et al. | 473/329 |
| 6,095,931 A | | 8/2000 | Hettingter et al. | |
| 6,238,303 B1 | | 5/2001 | Fite | |

* cited by examiner

*Primary Examiner*—Sebastiano Passaniti
(74) *Attorney, Agent, or Firm*—Darrell F. Marquette

(57) ABSTRACT

A golf club head includes a body (formed of cast titanium, steel, bronze, or the like) with a cavity formed therein behind a front face. An insert (e.g., an elastomeric insert) is provided through an opening exposed on a surface of the body (e.g., the sole of the club head) such that the insert is substantially encapsulated within the body. The opening or openings may be configured to provide a distinct visual appearance through the use of, for example, one or more rectangular and/or circular shapes. One or more supports and/or baffles may be provided within the cavity for altering the sound and feel of the club head during impact. Furthermore, the elastomeric insert may include a plurality of bubbles configured to alter the mechanical properties of the insert. The club head may be fabricated, for example, through the use machining techniques and/or a powdered metal or investment casting process.

17 Claims, 9 Drawing Sheets

METHODS AND APPARATUS FOR A GOLF CLUB HEAD WITH AN ENCAPSULATED INSERT

BACKGROUND OF THE INVENTION

1. Technical Field

This invention relates, generally, to golf clubs and, in particular, to a golf club head with an encapsulated insert.

2. Background Information

Recent trends in golf putter designs have emphasized, among other things, the nature of the striking surface of the club face. Just as a golfer's response to impact during a golf swing is highly individualized, and depends in part upon complex subjective and psychological factors, a golfer's preference for putter face material is also highly individualized. While many golfer's prefer a hard, highly-responsive solid metal surface and the attendant "hard" sound and feel, others prefer a "softer" feel, perceiving that a soft feel correlates to improved distance and accuracy.

Soft club face surfaces are typically manufactured from various non-metallic (generally polymeric) materials bonded to or incorporated into the striking surface of the club face. The elastic properties of these materials result in a much softer response during a golf swing; but, at the same time, they often produce a relatively dull sound and feel during impact, which can be undesirable to some golfers.

Known club head designs which attempt to combine the desirable aspects of both polymeric and metallic materials are unsatisfactory in a number of respects. For example, various prior art hybrid club heads include a polymeric insert secured behind a metal face-plate or inlay. Such systems can be costly to manufacture, in that additional steps must be performed in order to bond the metal face-plate to the club head and finish the resulting surfaces. Furthermore, the act of bonding the face-plate to the club (through, for example, epoxies and the like) adds another structural feature which can reduce the effectiveness of the face-plate. In addition, the use of very thin metallic face-plate materials (e.g., titanium) during club head assembly can be cumbersome and result in costly accidental breakage.

BRIEF SUMMARY OF THE INVENTION

The present invention provides a golf club head which includes a substantially elastic encapsulated insert configured to yield in response to the deflection of the front face of the club head during impact with a golf ball, thus providing desirable distance, control, and feel. One or more openings are provided on a suitable surface (or surfaces) of the club head, for example, the sole of the club head, to facilitate placement of the insert.

In accordance with one embodiment of the present invention, one or more openings are provided on the sole of the club head to provide a distinct visual appearance through the use of, for example, one or more rectangular and/or circular shapes.

In accordance with another aspect of the present invention, a plurality of supports are provided within a chamber behind the club face. In accordance with yet another aspect of the present invention, a plurality of baffles are provided within the cavity for impeding the flow of a gel or other viscous material provided within the cavity.

In accordance with another aspect of the present invention, one or more supports are provided within the cavity or space where the insert is placed. These supports may be configured to influence the sound and feel of the club head during impact.

In accordance with another aspect of the present invention, the insert includes a plurality of bubbles configured to alter the mechanical properties of the insert.

In accordance with another aspect of the present invention, an investment casting (or "lost-wax") process is used to fabricate the club head.

In accordance with another aspect of the present invention, a powdered metal process and or a conventional machining process is employed.

BRIEF DESCRIPTION OF THE DRAWINGS

The subject invention will hereinafter be described in conjunction with the appended drawing figures, wherein like numerals denote like elements, and.

DETAILED DESCRIPTION

The present invention overcomes the limitations of the prior art by providing a golf club head (for example, a putter club head) which includes an insert configured to deform in response to the deflection of the face of the club head during impact with a golf ball. One or more openings may be provided on a suitable surface (or surfaces) of the club head—for example, the sole of the club head—to facilitate formation of the insert within the club head and to create a distinctive visual appearance.

Figure 1:
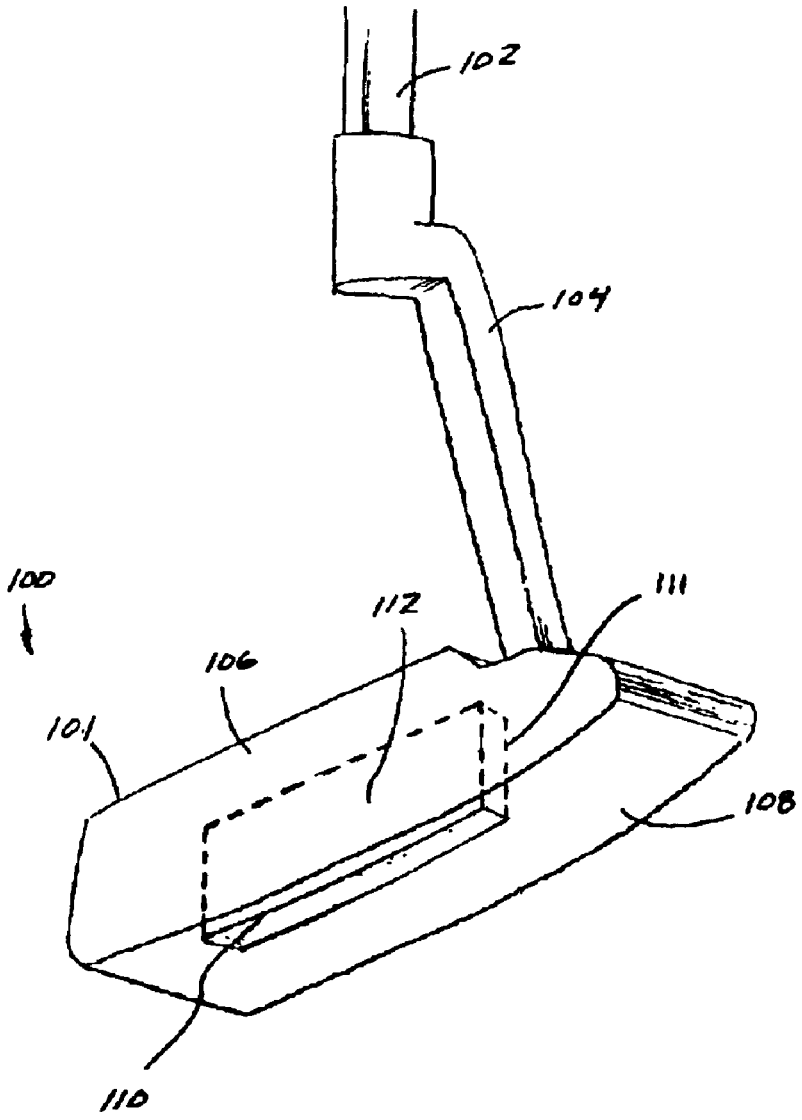
FIG. 1 is an isometric overview of a golf club head in accordance with one embodiment of the present invention.

Referring now to FIG. 1, a golf club head 100 in accordance with one embodiment of the present invention generally comprises a body 101 having a cavity 111 formed therein and an insert 112 provided within the cavity (described in further detail below). An opening 110 is provided on a surface of body 101 (e.g., the sole 108 of body 101) such that opening 110 is part of and/or communicates with cavity 111 occupied by insert 112. In addition, body 101 is typically attached to a shaft 102 via a suitable hosel 104.

Figure 2:
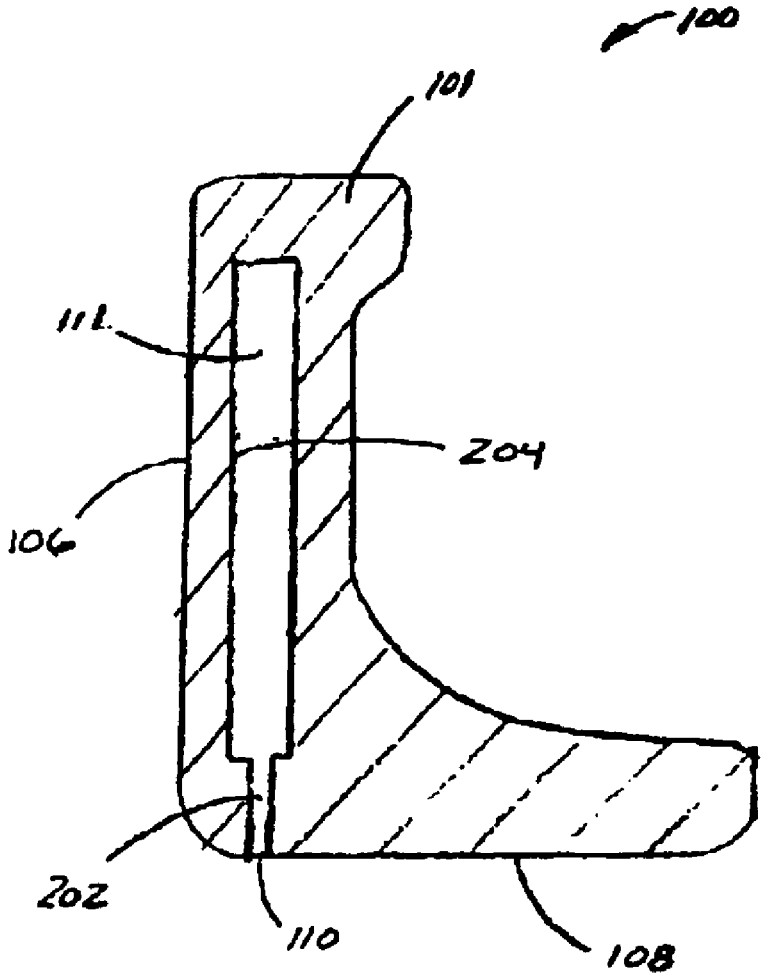
FIG. 2 is a cross-sectional view of a golf club head in accordance with one embodiment of the present invention.

FIG. 2 shows a cross-sectional view of an exemplary body 101 including a cavity 111 formed therein. Cavity 111 includes an interior surface 204 located opposite front face 106, which is arranged for impacting a golf ball. Opening 110, located on a suitable surface of body 101, facilitates the insertion (e.g., injection) of the insert or insert material into cavity 111. As illustrated, opening 110 may lead directly or indirectly to an optional passageway 202, which itself suitably leads to cavity 111. Alternatively, cavity 111 may extend downward and exit sole 108 with a uniform cross-section (e.g., as illustrated in simplified FIG. 1) or with any other convenient cross-section.

Body 101 comprises any suitable metal, plastic, and/or composite material. Acceptable materials include, for example, titanium, copper, steel (e.g., stainless steel), bronze, and the like. Depending upon the selected material or materials, body 101 may be formed through any convenient method, for example, via casting (e.g., investment casting, as described further below in conjunction with FIG. 10) and/or by conventional milling processes.

Body 101 is defined by any suitable club head shape, which may depend upon any number of factors, including, for example, club head type (putter, wood, etc.), desired moment of inertia (e.g., the polar moment of inertia around an axis normal to the club head sole), desired center of gravity, desired aesthetic properties (e.g., visual cues provided by the club head's contours as viewed from above during play) and/or the desired weight, mass, and density. In this regard, it will be appreciated that the exemplary club head shape depicted in the drawings is for illustrative purposes only, and that the present invention is not so limited.

The cavity 111 formed in body 101 may also be have any suitable shape. In the illustrated embodiment, a rectilinear cavity 111 is shown. Cavity 111 may, for example, have a constant cross-section perpendicular to the major axis of the club head, e.g., a cross-section which is rectangular (as shown), rectilinear, curvilinear, oval, circular, polygonal, or any arbitrary partially or wholly enclosed shape. Alternatively, cavity 111 may have a non-constant cross-section i.e., the cross-section may vary in shape and/or dimension as it progresses from one end of the club head to the other (e.g., from the heel of the club head to the toe). In an alternate embodiment, multiple cavities may be provided within body 101, each having one or more associated openings on one or more surfaces of body 101.

Cavity 111 may be configured such that the thickness of body 101 between interior surface 204 and front face 106 varies or is constant. While the illustrated embodiment shows a constant thickness between front face 106 and surface 204 (i.e., interior surface 204 is, over much of its length, planar and substantially parallel with planar face 106), the present invention contemplates embodiments wherein surface 204 and front face 106 are non-parallel and/or non-planar. For example, interior surface 204 may be convex, concave, or have any arbitrary two-dimensional manifold shape. Interior surface 204 may also be textured or have a variety of ribs, depressions, or other structures formed thereon.

The face thickness (measured between front face 106 and surface 204) may be selected in accordance with the desired design goals. In one embodiment, for example, the face thickness suitably ranges between approximately 20 and 200 mils (thousandths of an inch).

Figure 3:
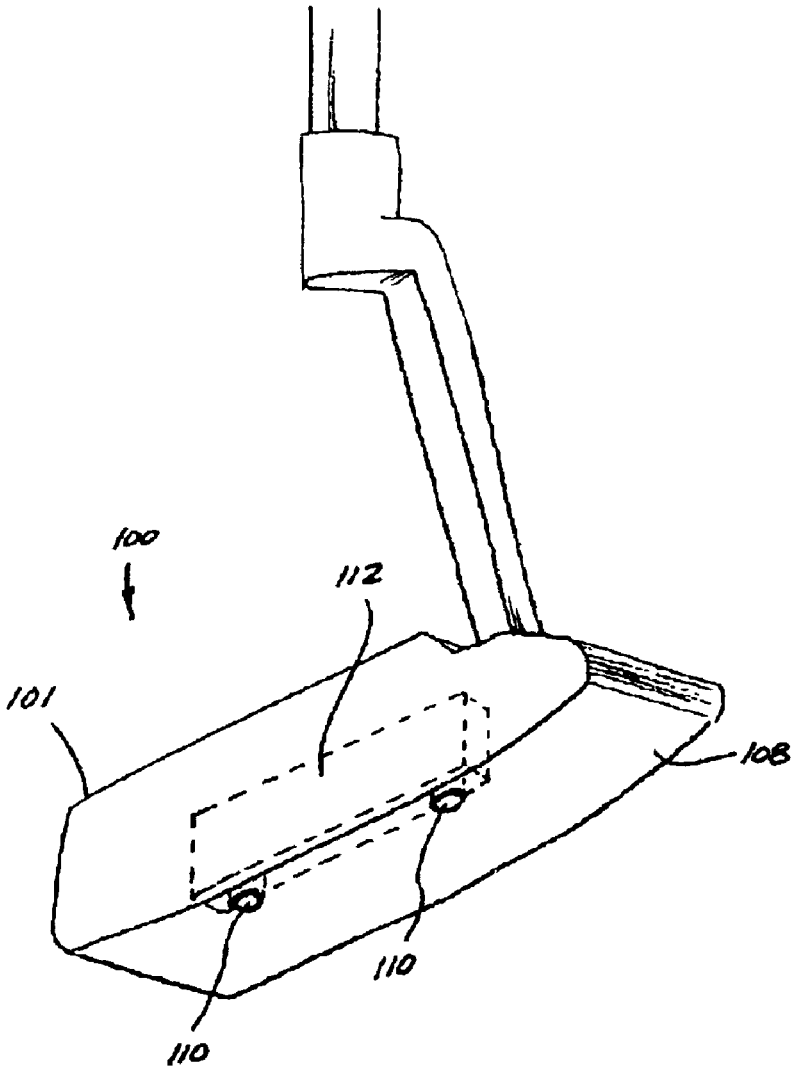
FIG. 3 is an isometric overview of a golf club head, showing an opening pattern in accordance with one embodiment of the present invention.
Figure 4:
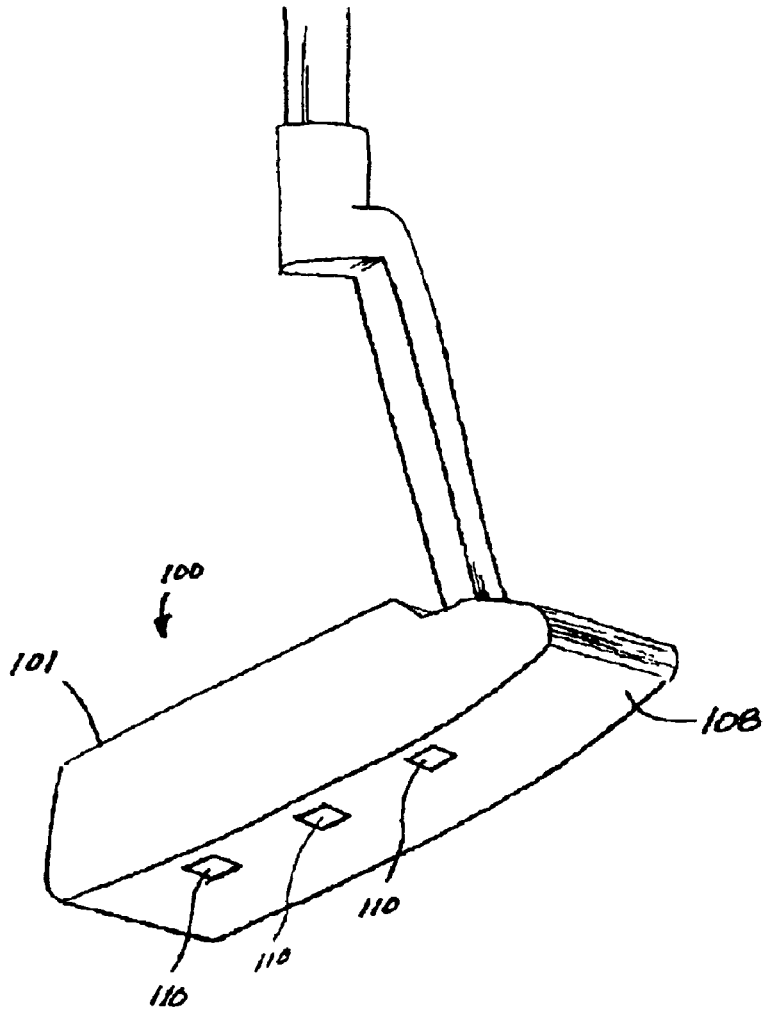
FIG. 4 is an isometric overview of a golf club head, showing an opening pattern in accordance with another embodiment of the present invention.

Referring now to FIG. 3, opening 110 may be provided on an appropriate surface of body 101 (e.g., sole 108) such that the insert 112 or plug material provides a distinct visual appearance. This distinct visual appearance may be provided through the use of any combination of shapes, colors, textures, and the like. In FIG. 3, for example, two circular openings 110 are shown, wherein the diameter of the openings 110 are substantially equal to the thickness of the insert 112. In another embodiment, shown in FIG. 4, three rectangular openings 110 are provided on a surface of club head 100. In addition to various planar geometrical shapes, openings 110 may correspond to, for example, numerals, letters, pictographs, trademarks, or the like.

Figure 5:
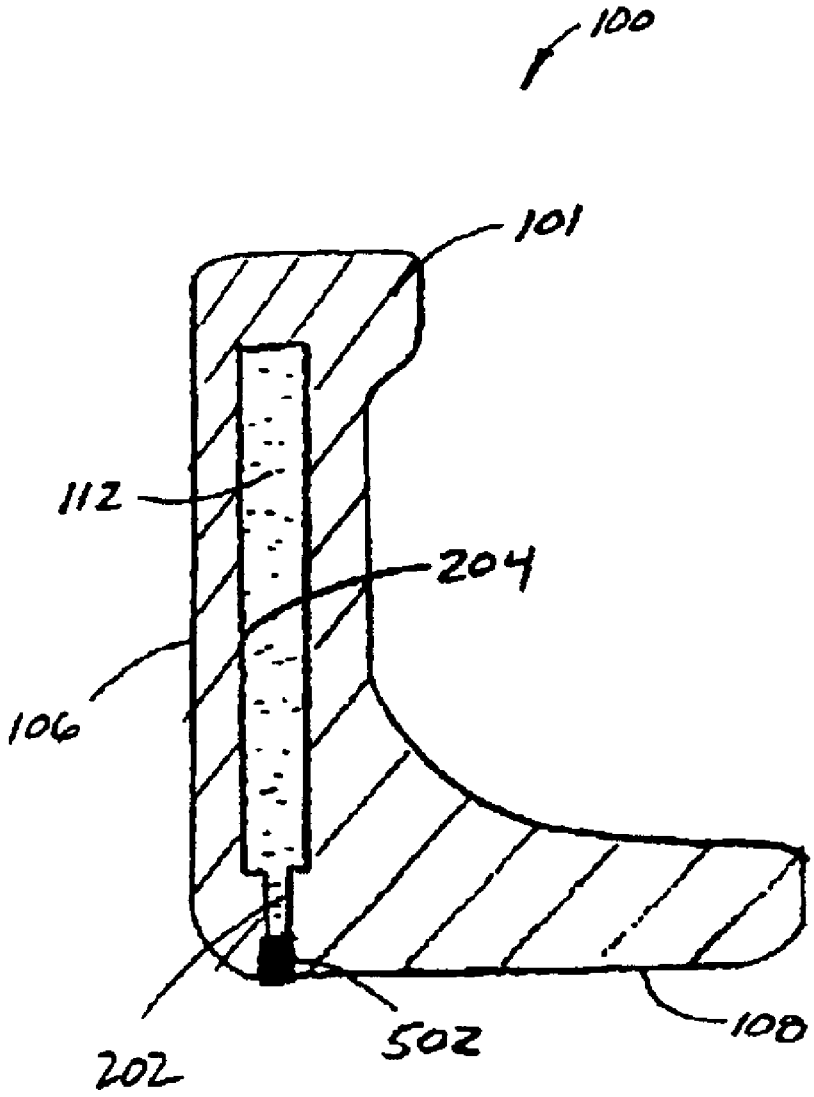
FIG. 5 is a cross-sectional view of a club head in accordance with another embodiment of the present invention wherein a plug is provided within the opening.

FIG. 5 depicts an alternate embodiment of the present invention which includes a plug 502 (e.g., a plug comprising a conventional or industrial epoxy) partially filling the cavity 111 and/or passageway 202 after insert 112 has been formed. In an alternative embodiment, the color of plug 502 (and/or insert 112) may be selected arbitrarily, for aesthetic reasons, or as an indicator of one or more characteristics of club head 100 (e.g., to indicate the composition of insert 112, to indicate weight or moment of inertia, etc.).

It will be appreciated that the exemplary openings shown in FIGS. 1–5 are not intended as a limitation of possible opening geometries. Similarly, while the various figures depict openings 110 located on the sole 108 of body 101, the present invention comprehends any suitable surface that may reasonably accommodate an opening, e.g., the face, top, back, sole, and sides of the club head. Moreover, it is possible to incorporate openings into two or more of such surfaces.

Insert 112 comprises any suitable material or combination of materials configured to elastically deform in response to the deflection of face 106 during impact with a golf ball. In this way, the club head provides desirable distance, control, and feel. Furthermore, in accordance with another aspect of the present invention, the substantially central encapsulation of insert 112 which has a lower density than the surrounding material for body 101 results in a higher moment of inertia for club head 100. The higher the moment of inertia, the less likely the club head 100 will twist when club head 100 impacts a golf ball at an off-center location.

In an exemplary embodiment, insert 112 comprises a polymeric material capable of withstanding repeated cycles of elastic deformation without exhibiting significant degradation of mechanical properties. Toward this end, a preferred embodiment of the present invention includes an insert 112 comprising an elastomeric compound. As is known, an elastomer is an amorphous, cross-linked polymer which can undergo large deformations (for example, 200% deformation) and recover almost completely and instantaneously upon release of the deforming forces. That is, elastomers are a category of polymers defined not by their chemical structure, but by their physical properties.

A variety of elastomers are appropriate for forming insert 112, including, for example, thermoset elastomers (polyurethane, silicone, and the like), thermoplastic elastomers (olefinics, styrenics, polyurethanes, and polyesters), and natural and synthetic rubbers. In one embodiment, insert 112 comprises polyurethane having a Shore D hardness of 60–70. For additional information regarding these and other elastomeric compounds, and methods for forming these compounds, see, e.g., CHARLES A. HARPER, HANDBOOK OF PLASTICS, ELASTOMERS, AND COMPOSITES (1996), and ANIL K. BHOWMICK, HANDBOOK OF ELASTOMERS, Plastics Engineering vol. 61 (2000). Both of these texts are hereby incorporate by reference.

Insert 112 may include one or more additives and/or fillers selected to modify the physical properties of insert 112. In accordance with one embodiment of the present invention, insert 112 includes a plurality of bubbles, for example, air bubbles, distributed throughout its bulk to alter the mechanical properties of the insert. The size, density, and distribution of the bubbles may be selected to accomplish any suitable change in mechanical characteristics, including, for example, elastic modulus, hardness, and the like. The bubbles may be introduced into the insert 112 at any convenient point in its processing, for example, prior to formation of the insert 112 (with bubbles already incorporated into the material being used to form the insert) and/or during formation of the insert (e.g., by mixing the air or other gas with the material as it is being injected or otherwise provided within cavity 111).

In an alternate embodiment of the present invention, only a portion of cavity 111 is filled with insert 112, thus allowing a portion of cavity 111 to remain filled by air or another gas. In a preferred embodiment, however, at least a portion of the interior surface 204 of cavity 111 contacts insert 112 such that the deflection of the club head face is at least partially absorbed by the insert material.

Figure 6:
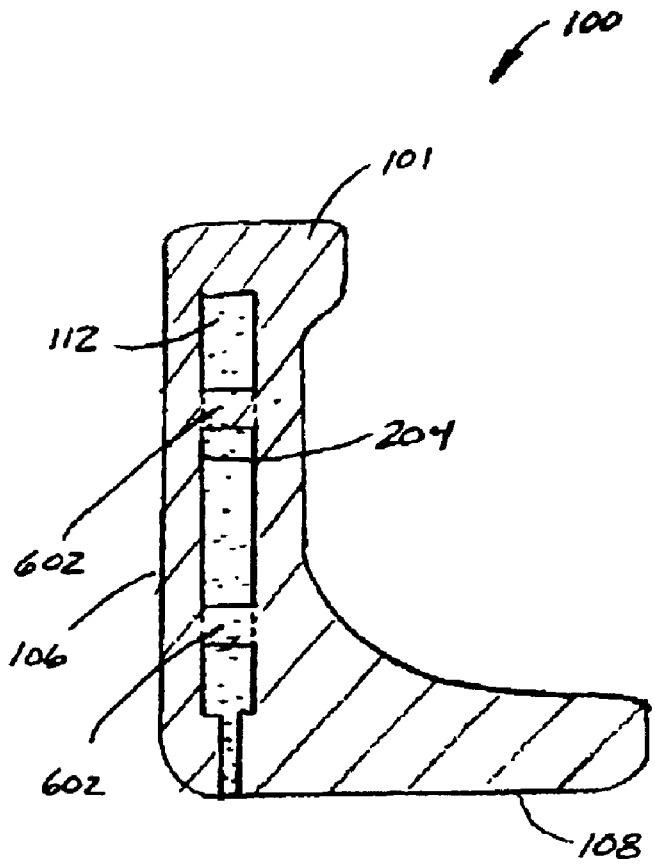
FIG. 6 is a cross-sectional view of a club head in accordance with another embodiment of the present invention wherein one or more supports are provided within the cavity of the golf club head body.

In accordance with an alternate embodiment of the present invention, a club head includes one or more internal supports provided in the cavity to support the club head face from behind. More particularly, referring now to FIG. 6, one or more supports 602 are integrated into or attached to interior surface 204 such that they extend through the thickness of insert 112 and are anchored to body 101, thus helping to support front face 106. Incorporation of supports 602 also alters the sound, feel, and momentum transfer experienced during impact with a golf ball.

Figure 7:
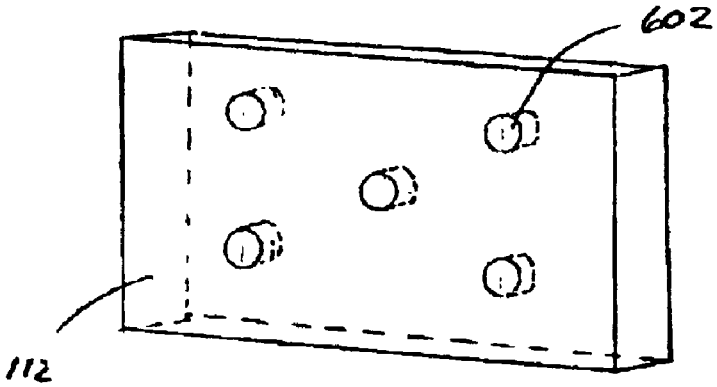
FIGS. 7, 8, and 9 show isometric cut-away views of various patterns for supports extending through the elastomeric insert.
Figure 8:
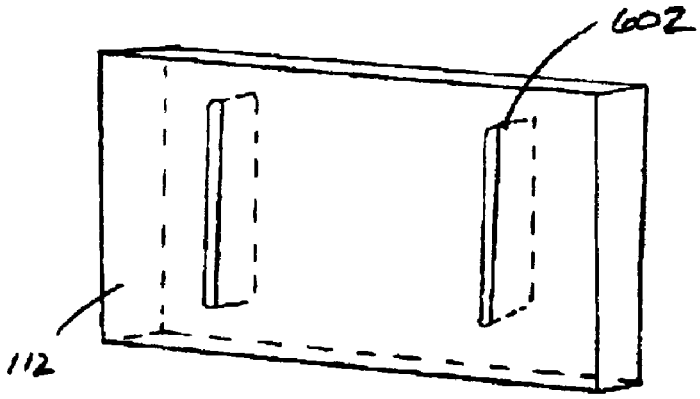
Figure 9:
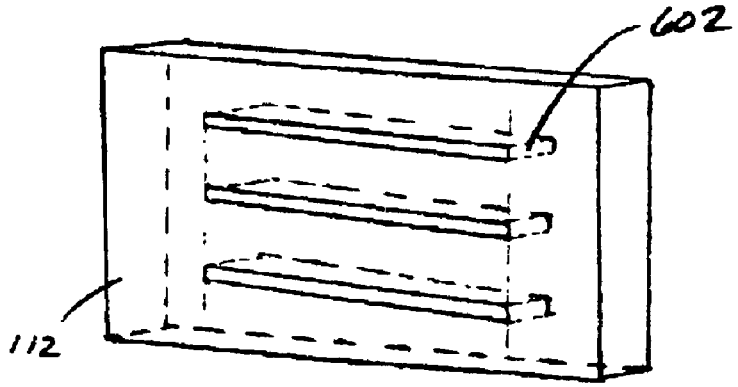

Any suitable number and pattern of supports 602 may be incorporated into the design. For example, FIGS. 7, 8, and 9 show, respectively, the use of multiple (e.g., five) cylindrical supports 602, multiple vertical ribs 602, and multiple horizontal ribs 602.

Figure 11:
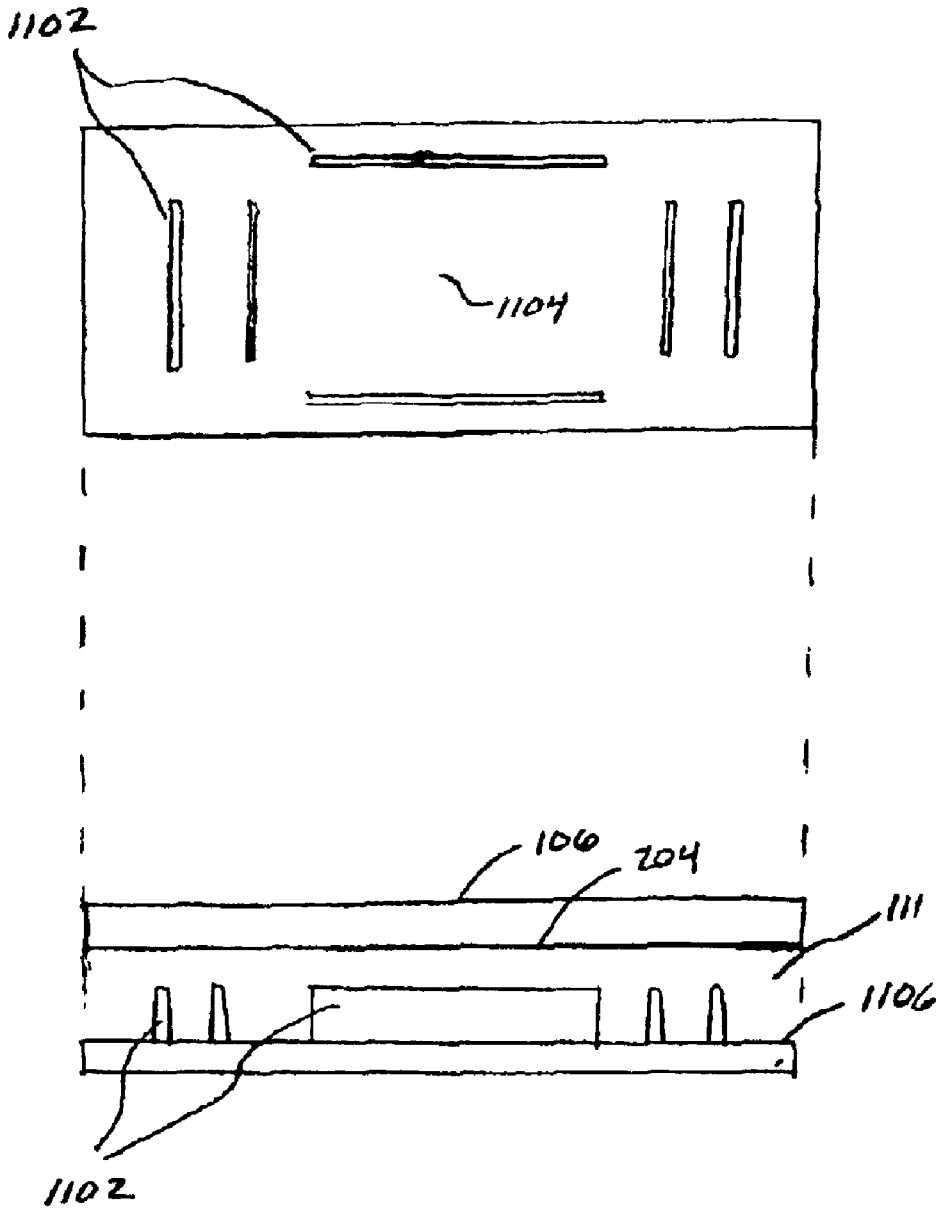
FIG. 11 show front and side views of a baffle structure in accordance with another aspect of the present invention.

Referring to FIG. 11, a plurality of baffles 1102 may be provided within the cavity to impede the flow of a gel or other viscous insert material provided within the cavity. That is, baffles 1102 preferably extend only partially from surface 1106 to inner surface 204 of cavity 111 (or from surface 204 to surface 1106). In this way, when the front face 106 is impacted by a golf ball, the insert material in central region 1104 is compressed and attempts to flow outward to the perimeter of the cavity. Baffles 1102 provide an impediment to such flow, thereby altering the dynamic response and feel of the club head. Any number of baffles 1102 may be configured in any convenient arrangement and spacing. That is, while vertical and horizontal baffles are shown in FIG. 11, any suitable rectilinear or curvilinear baffle shape may be employed. Likewise, baffles 1102 may be spaced regularly, irregularly, or randomly within cavity 111.

A method of fabricating a golf club head in accordance with one embodiment of the present invention generally involves an investment-casting or "lost-wax" process—a processing method which desirable due to its cost effectiveness and precise dimensional control. In this regard, conventional investment casting techniques known to those skilled in the art will not be described in detail herein. For more information regarding such processes, see, e.g., SOPCAK, HANDBOOK OF LOST WAX OR INVESTMENT CASTING (1986), which is hereby incorporated by reference.

In addition, while an investment casting process is described in detail below, it will be understood that any suitable manufacturing technique may be employed to realize the club head of the present invention; for example, powdered-metal processing and/or metal machining.

Figure 10:
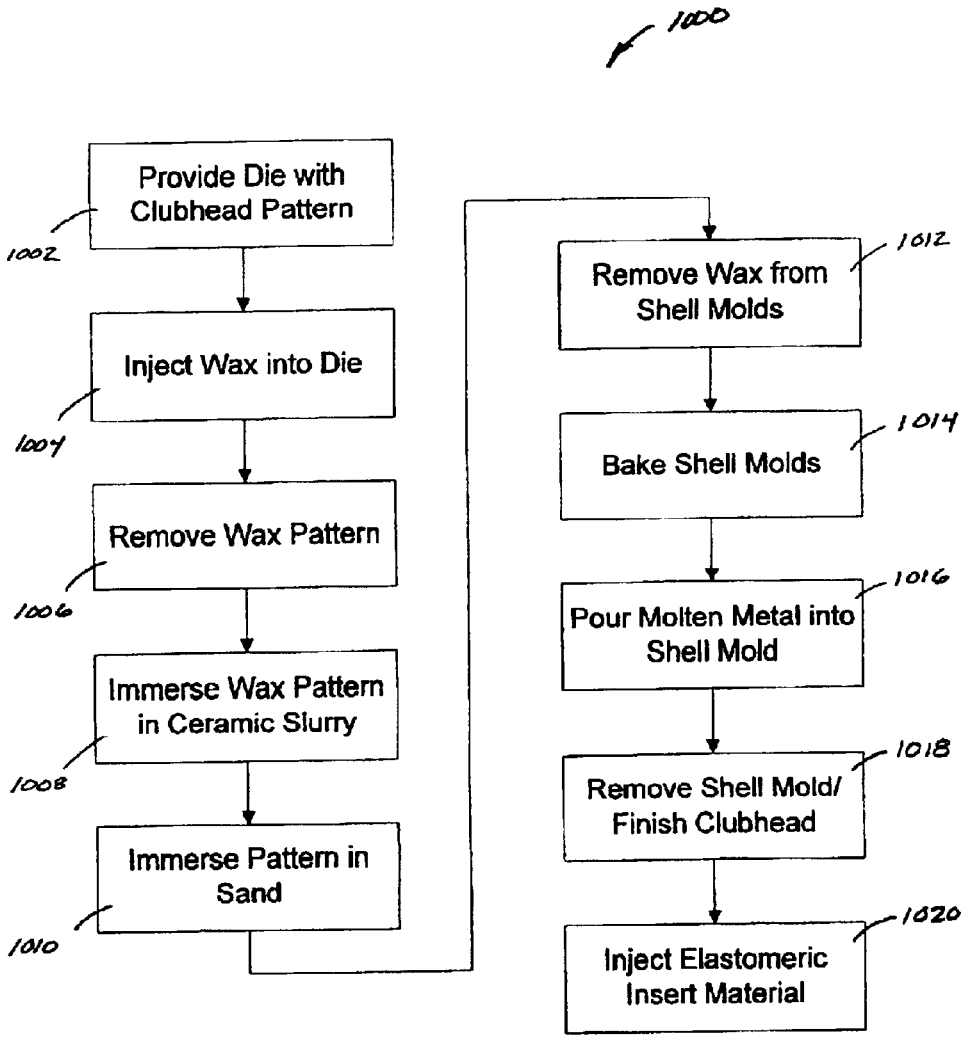
FIG. 10 is a flowchart depicting an investment casting process in accordance with one aspect of the present invention.

Referring now to FIG. 10, an exemplary method 1000 for manufacturing a golf club head begins in step 1002 with the creation of a die having a club head shape formed therein. This club head die includes a cavity and one or more openings as described in detail above. The die, which may be fabricated by machining a block of aluminum or other suitable material, might also include internal supports as illustrated in FIGS. 6–9.

Next, in step 1004, a suitable wax (in liquid or paste form) is injected into the die and allowed to cool to form a solidified wax pattern or "sacrificial replica." The resulting solidified wax pattern is then removed from the die (step 1006). A number of such wax patterns may be attached to a central wax stick or "sprue" to form a cluster of wax patterns.

Next, in step 1008, the solidified wax pattern is immersed in a suitable ceramic slurry, for example, a slurry comprising a mixture of a thermoset binder, a refractory material, and a silica (e.g., alumina-silicate, ethyl silicate, or the like).

The slurry adhering to the wax pattern is allowed to dry, and the solidified wax pattern (now coated with a ceramic layer) is then immersed in a bed of suitably fine sand (e.g., fine silica or zirconia) to form a shell mold around the solidified wax pattern (step 1010). This sand-immersion step may be performed repeatedly until a suitable thick shell is formed, for example, a shell having a total thickness of about 5–10 mm.

Next, in step 1012 the solidified wax pattern is melted or otherwise removed from the inner chambers of the shell mold. This is often referred to as the "dewaxing step," and may be accomplished through the use of an oven or autoclave (e.g., a steam autoclave). The shell mold is then baked in a suitable oven to harden the shell and remove any residual wax (step 1014). At this point, one or more hardened shell molds have been formed. These shell molds will serve as the basis for metal casting of the actual club head as described below.

In step 1016, the shell mold is filled with molten metal (e.g., titanium, copper, bronze, aluminum, steel, or the like). This filling step may be performed using any convenient method, for example, conventional gravity pouring, centrifugal casting, or counter-gravity casting. The molten metal is cooled to produce a hardened club head shape surrounded by the shell mold.

Next, in step 1018, the shell mold is removed using any convenient method, thus revealing the cast club head. This may be accomplished, for example, by vibrating the assembly such that the brittle shell mold fractures and falls away, or by using one or more jets of high-pressure water. In the event that multiple wax patterns were attached to a sprue, the individual club heads are suitably cut way from the central sprue using, for example, a high-speed friction saw.

Various finishing operations may then be performed on the cast club head, including, for, example, cleaning, texturing, and/or milling of the resulting surfaces. In accordance with another aspect of the present invention, the resulting cast club head may be subjected to hot isostatic pressing ("HIPping") under high temperature and pressure. This process tend to reduce the amount of voiding present in the cast club head.

In step 1020 the insert is injected or otherwise placed into the cavity of the club head through the opening or openings formed on the surface of the club head body. In one embodiment, the insert comprises an elastomeric material injected into the club head cavity in substantially liquid form and then cured or otherwise solidified. As described above, a plug or the like may be inserted into the opening to further seal the club head.

In conclusion, what has been provided is a golf putter club head which includes a substantially elastic encapsulated insert provided through one or more openings on a surface of the club head. A particularly preferred embodiment of the present invention, for example, includes a cast metal club head body (e.g., a titanium body) with an elastomeric insert substantially filling a cavity with a substantially planar interior surface opposite a relatively thin club head face. The relatively hard hitting surface combined with the compliant nature of the polymeric insert results in a distance, control, and feel that is unmatched by prior art golf club heads, including, for example, club heads which include a layer of elastomer placed behind a metal face or inlay.

Although the invention has been described herein in conjunction with the appended drawings, those skilled in the art will appreciate that the scope of the invention is not so limited. For example, while the present invention has been described in terms of golf putters, many other types of golf clubs would profit from the present invention, including irons, metal woods, etc. These and other modifications in the selection, design, and arrangement of the various components and steps discussed herein may be made without departing from the scope of the invention as set forth in the appended claims.

What is claimed is:

1. A golf club head comprising:

a metallic putter body having a cavity formed therein, said body having a front face arranged for impacting a golf ball, said cavity having an interior surface opposite said front face;

an insert provided within said cavity and substantially encapsulated by said body, said insert comprising a polymer contacting said interior surface and configured to elastically deform when said front face impacts a golf ball;

an opening on an exterior surface of said body, said opening communicating with said cavity to facilitate forming said insert within said cavity of said body wherein said exterior surface includes a sole of said body, and wherein said opening is provided on said sole, wherein said cavity is configured such that said interior surface and said front face are separated by a thickness, and wherein said thickness is selected to allow said insert to deform in response to said front face striking a golf ball.

2. The club head of claim 1, wherein said insert is selected from the group consisting of thermoset elastomers and thermoplastic elastomers.

3. The club head of claim 1, wherein said insert comprises an elastomer selected from the group consisting of polyurethane, silicone, natural rubber, synthetic rubber, olefinic polyester, and styrenic polyester.

4. The club head of claim 1, wherein said insert further includes a plurality of bubbles configured to modify a mechanical property of said insert.

5. The club head of claim 1, wherein said body comprises a metal selected from the group consisting of titanium, steel, bronze, and aluminum.

6. The club head of claim 1, wherein said opening comprises at least one rectangular area.

7. The club head of claim 1, wherein said opening comprises at least one circular area.

8. The club head of claim 1, wherein said opening communicates with said cavity through one or more passageways.

9. The club head of claim 1, further comprising a plug provided within said opening.

10. The club head of claim 1, further including at least one support coupled to said interior surface.

11. The club head of claim 10, wherein said at least one support comprises at least one cylindrical support.

12. The club head of claim 10, wherein said at least one support comprises at least one vertical rib.

13. The club head of claim 10, wherein said at least one support comprises at least one horizontal rib.

14. The club head of claim 1, further including a plurality of baffles within said cavity to impede the flow of said insert during impact.

15. The club head of claim 1, wherein said thickness is substantially constant.

16. The club head of claim 15, wherein said interior surface and said front face are substantially planar.

17. The club head of claim 1, wherein said thickness is approximately 20 mils to 200 mils.

* * * * *